US011615736B2

(12) United States Patent
Ding et al.

(10) Patent No.: US 11,615,736 B2
(45) Date of Patent: Mar. 28, 2023

(54) LIGHT-EMITTING DIODE (LED) DISPLAY DRIVER WITH BLANK TIME DISTRIBUTION

(71) Applicant: Texas Instruments Incorporated, Dallas, TX (US)

(72) Inventors: Shang Ding, Shanghai (CN); Huibo Zhong, Shanghai (CN); Yang Wang, Shanghai (CN); Haibin Shao, Shanghai (CN); Mingming Hou, Shanghai (CN); Yongjie Huang, Shanghai (CN); Jing Zhang, Shanghai (CN)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

(21) Appl. No.: 17/183,674

(22) Filed: Feb. 24, 2021

(65) Prior Publication Data

US 2022/0076615 A1 Mar. 10, 2022

Related U.S. Application Data

(60) Provisional application No. 63/076,145, filed on Sep. 9, 2020.

(51) Int. Cl.
*G09G 3/32* (2016.01)
*G09G 3/20* (2006.01)
(Continued)

(52) U.S. Cl.
CPC ..... *G09G 3/32* (2013.01); *G09G 3/2018* (2013.01); *G09G 3/2022* (2013.01);
(Continued)

(58) Field of Classification Search
CPC ..... G09G 3/2018; G09G 3/2022; G09G 3/32; G09G 3/3208; G09G 3/3216;
(Continued)

(56) References Cited

U.S. PATENT DOCUMENTS 5,731,802 A * 3/1998 Aras ..... G09G 3/2022 345/98
8,026,894 B2 9/2011 Feng
(Continued)

FOREIGN PATENT DOCUMENTS

CN 102779480 B 4/2015
CN 210378420 U 4/2020

OTHER PUBLICATIONS

Search Report for Pat. Appl. No. 2021/048144, dated Nov. 18, 2021.

*Primary Examiner* — Jason M Mandeville
(74) *Attorney, Agent, or Firm* — Ray A. King; Frank D. Cimino

(57) ABSTRACT

A light-emitting diode (LED) display driver is operable to drive LEDs of an LED display and has a display interval with sub-periods and a blank time, each sub-period having multiple segments. The LED display driver includes: a data input; LED channel outputs adapted to be coupled to LEDs to drive the LEDs; and blank time distribution circuitry coupled between the data input and the LED channel outputs. The blank time distribution circuitry operable to distribute the blank time as blank time portions added to at least some of the sub-periods. Each blank time portion is smaller than a duration of each sub-period.

18 Claims, 8 Drawing Sheets

(51) Int. Cl.
*G09G 3/3208* (2016.01)
*G09G 3/3225* (2016.01)

(52) U.S. Cl.
CPC ..... *G09G 3/3208* (2013.01); *G09G 3/3225* (2013.01); *G09G 2310/0202* (2013.01); *G09G 2320/064* (2013.01)

(58) Field of Classification Search
CPC ..... G09G 3/3225; G09G 2310/0202; G09G 2310/061; G09G 2320/064; G09G 2320/0209
USPC ..... 345/691, 76
See application file for complete search history.

(56) References Cited

U.S. PATENT DOCUMENTS

| | | | | |
|---|---|---|---|---|
| 10,170,049 | B2 | 1/2019 | Ryu et al. | |
| 2019/0051244 | A1* | 2/2019 | He | G09G 3/2025 |

* cited by examiner

LIGHT-EMITTING DIODE (LED) DISPLAY DRIVER WITH BLANK TIME DISTRIBUTION

CROSS-REFERENCE TO RELATED APPLICATIONS

This application claims priority to U.S. Provisional Application No. 63/076,145, filed Sep. 9, 2020, which is hereby incorporated by reference.

BACKGROUND

Light-emitting diode (LED) displays are widely used in electronic device. Cell phones, portable gaming devices, televisions, equipment displays, personal electronics, cameras, displays in automobiles and electronic signs may incorporate LED displays, LED display driver circuits (sometimes referred to as "LED display drivers" herein) may be necessary to properly illuminate LED devices for usage in LED displays. In LED devices, there are some trends: the number of red-green-blue (RGB) LED pixels are increasing (e.g., up to 4K pixels and more than 15K LED drivers); the pitch between pixels is decreasing; and the refresh rate (e.g., up to 4 KHz) is increasing to account for increases in camera shutter speed (to avoid visibility of dimming lines in photography of LED signage). With the pixel density getting higher in narrow pixel pitch LED display products, there is an urgent demand for LED drivers to address one critical challenge: ultra-high integration to meet strict board space limitation. To increase the system integration, a time-multiplexing circuit is used in LED display drivers. An example LED display driver is configured to drive an m×48 LED matrix, where m is the number of scan lines. Each scan line is activated using a respective switch included with the LED display driver. In one example, an LED display driver includes 48 channels OUTR0, OUTG0, OUTB0, OUTR1, OUTG1, OUTB1, . . . , OUTR15, OUTG15, OUTB15 to drive an LED matrix having 16 sets of red, green, blue (RGB) pixels.

One of the challenges for LED displays is to account for how the LED display will appear in photography. With the shutter speeds of modern cameras, solving this challenge is not a trivial task. During LED display operations, each frame includes some blank time, which can be detected as black field phenomena in photography captured by modern cameras.

SUMMARY

In an example embodiment, a light-emitting diode (LED) display driver is operable to drive LEDs of an LED display and has a display interval with sub-periods and a blank time, each sub-period having multiple segments. The LED display driver includes: a data input; LED channel outputs adapted to be coupled to LEDs to drive the LEDs; and blank time distribution circuitry coupled between the data input and the LED channel outputs. The blank time distribution circuitry operable to distribute the blank time as blank time portions added to at least some of the sub-periods. Each blank time portion is smaller than a duration of each sub-period.

In another example embodiment, a system comprises: a light-emitting diode (LED) display controller; and an LED display driver coupled to the LED display controller and configured to receive LED data from the LED display controller. The LED display driver is operable to drive LEDs of an LED display and having a display interval with sub-periods and a blank time, each sub-period having multiple segments. The LED display driver includes: a data input; LED channel outputs adapted to be coupled to LEDs of an LED display; and blank time distribution logic coupled to the data input and the LED channel outputs. The blank time distribution logic is operable to distribute the blank time as blank time portions added to at least some of the sub-periods of the display interval, wherein each blank time portion is smaller than a duration of each sub-period.

In yet another example embodiment, a method for distributing blank time portions of a display interval with sub-periods, each sub-period having multiple segments, and a blank time is provided. The method comprises obtaining, by an LED display driver, a blank time distribution setting. The method also comprises generating control signals, by the LED display driver, responsive to the blank time distribution setting. The method also comprises adjusting, by the LED display driver, an off-time for channel pulses responsive to the control signals.

BRIEF DESCRIPTION OF THE DRAWINGS

The same reference numbers are used in the drawings to designate the same (or similar) features.

DETAILED DESCRIPTION

Figure 1:
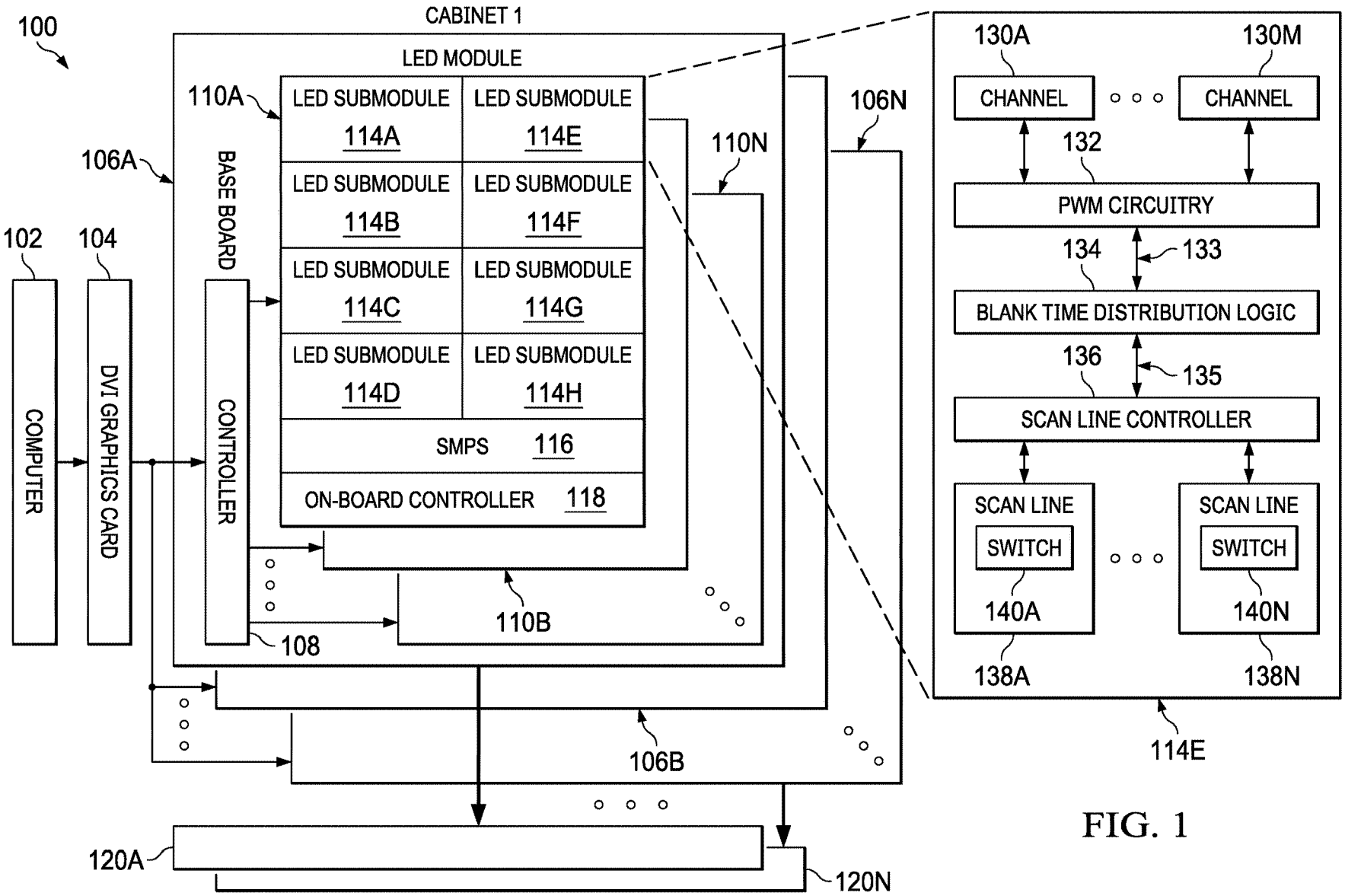
FIG. 1 is a block diagram of a system in accordance with an example embodiment.

Described herein is a light-emitting diode (LED) display driver with blank time distribution to avoid black field phenomena in LED display photography. In some example embodiments, an LED display includes an LED display controller and LED display drivers. The LED display controller is able to determine a blank time from available parameters such as a system clock rate, an LED display refresh rate, a number of scan lines, a number of channels, and/or other parameters. As used herein, "blank time" refers to a time interval within a frame or display interval in which there is no output to the LED channels. As used herein, a "frame" or "display interval" is a time interval at which one of consecutive images appears on a display. The frame or display interval is given as:

$$T_{Frame}=n\times T_{Sub\text{-}period}+T_{Blank} \quad (1)$$

where $T_{Frame}$ is the frame period, $T_{Sub\text{-}period}$ is the period for sequencing through all scan lines, $T_{Blank}$ is the blank time, and n is an integer. In different example embodiments, $T_{Frame}$ varies depending on the refresh rate of a display, and $T_{Sub\text{-}period}$ varies depending on the number of scan lines. Accordingly, n will also vary and will be equal to however many of $T_{Sub\text{-}period}$ fits within $T_{Frame}$. The leftover interval ($T_{Frame}-n\times T_{Sub\text{-}period}$), if any, is $T_{Blank}$.

Once the blank time is determined, the LED display controller provides the blank time, related parameters (e.g., a number of clock cycles corresponding to the blank time), or a blank time distribution setting to the LED display driver. The LED display driver uses the blank time, related parameters, or the blank time distribution setting to implement blank time distribution operations. In some example embodiments, the LED display driver performs blank time distribution by: 1) distributing a blank time portion to each segment of each sub-period of a display interval responsive to the blank time being greater than a first threshold; 2) distributing a blank time portion to each sub-period, but not each segment of each sub-period, of the display interval responsive to the blank time (or remaining blank time after a previous blank time distribution) being equal to or less than the first threshold and greater than a second threshold; and 3) distribute a blank time portion to only some sub-periods of a display interval responsive to the blank time (or remaining blank time after a previous blank time distribution) being equal to or less than the second threshold. In some example embodiments, the distribution options are combined. As an example, if the blank time corresponds to 1000 clock cycles and there are 800 segments and 150 sub-periods in a frame, blank time distribution may involve: distributing one blank time clock cycle to each segment; distributing one blank time clock cycle to each sub-period; and distributing one blank time clock cycle to every third sub-period.

In some example embodiments, blank time distribution involves adjusting a PWM pulse for certain segments of a frame to increase its off-time (e.g., by 1, 2, or 3 clock cycles). Also, a scan line controller coupled to each respective switch (e.g., field-effect transistors or FETs) of a set of scan lines may receive related information and vary the timing of its operations to account for changes to a segment time interval responsive to the blank time distribution setting. In other words, the timing of scan line sequencing is adjusted as needed to account for blank time distribution.

FIG. 1 is a block diagram of a system 100 in accordance with an example embodiment. In some example embodiments, the system 100 is an LED display device (sometimes referred to as LED signage). As shown, the system 100 includes a computer 102 that provides the source of the graphics and communicates with a digital visual interface (DVI) graphics card 104. In operation, the DVI graphics card 104 converts graphics source data and provides the data to a plurality of cabinets 106A-106N, where each of the cabinets 106A-106N includes a base board controller 108 and a plurality of LED modules 110A-110N. In different examples, the DVI graphics card 104 provides the same graphics data or different graphics data to each of the cabinets 106A-106N, where each of the cabinets 106A-106N is associated with a different LED display 120A-120N.

In the example of FIG. 1, each of the plurality of LED modules 110A-110N includes a plurality of LED submodules 114A-114H, a switched-mode power supply (SMPS) 116, and an on-board controller 118 (sometimes referred to herein as an LED display controller). In operation, each base board controller 108 is configured to receive graphics data from the DVI graphics card 104 and to provide LED data or related data to each LED module 110A-110N. For example, each on-board controller 118 of each respective LED module 110A-110N is configured to receive LED data or related data from a respective base board controller 108 and to provide a sub-set of the LED data or related data to each of the LED submodules 114A-114H.

In operation, each of the LED submodules 114A-114H is configured to manage the amount of current provided to respective pixels (e.g., red, green, blue pixels), where current flow to each pixel is a function of scan line operations as well as current source or current sink operations. As described herein, LED display drivers (e.g., the LED submodules 114A-114H) perform blank time distribution operations.

In FIG. 1, the LED submodule 114E is shown in more detail. As shown, the LED submodule 114E includes channels 130A-130N. In different example embodiments, the number of channels 130A-130N vary (e.g., 16, 32, or 48 channels). The channels 130A-130N are coupled to PWM circuitry 132, which is configured to provide pulses to each of the channels 130A-130N. The channels 130A-130N include LED channel outputs (see e.g., OUTR0-OUTR15, OUTG0-OUTG15, and OUTB0-OUTB15 in FIG. 7) coupled to LEDs (e.g., LEDs 706 in FIG. 7) of an LED display (e.g., one of the displays 120A-120N in FIG. 1). As shown, the PWM circuitry 132 is coupled to blank time distribution logic 134, which provides control signals to the PWM circuitry 132 to perform blank time distribution. In some example embodiments, the PWM circuitry 132 uses control signals 133 from the blank time distribution logic 134 to adjust the off-time of pulses in a manner that distributes blank time evenly. The blank time distribution logic 134 is also coupled to and provides control signals 135 to a scan line controller 136. The scan line controller 136 uses the control signals 135 to adjust the timing of a scan line sequence to account for changes in the duration of segments of a frame due to blank time distribution. The scan line sequence from the scan line controller 136 is used to control respective switches 140A-140N of a set of scan lines 138A-138N. With blank time distribution operations, the LED submodule 114E is able to avoid or reduce black field phenomena. In FIG. 1, each of the LED submodules 114A-114H include the same or similar components as those described for the LED submodule 114E.

Figure 2:
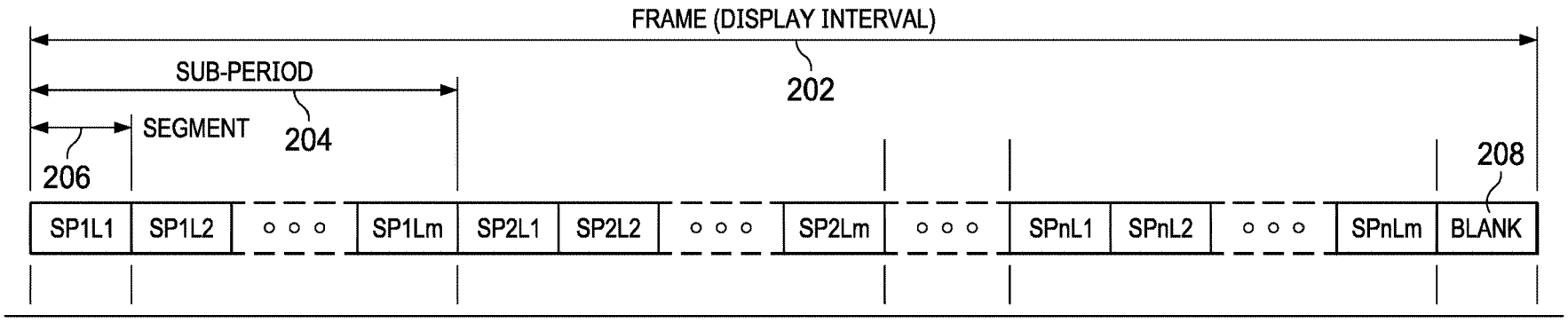
FIG. 2 (PRIOR ART)
FIG. 2 is a diagram of a frame or display interval in accordance with a conventional approach.

FIG. 2 is a diagram of a frame or display interval 200 in accordance with a conventional approach. As shown, the entire frame 200 occurs within an interval 202. The interval 202 includes n sub-periods 204 and a blank interval 208. The blank interval 208 is the time left over in the interval 202 when there is not enough time for another sub-period 204. During the blank time interval 208, a related LED display driver is inactive.

As shown, each of the n sub-periods 204 include m scan line segments 206. Each of the m scan line segments 206 of a given sub-period 204 is related to a different scan line. To summarize, the frame 200 is a time reference with scan line segments 206 and related sub-periods 204 for each scan line sequence (e.g., there are m scan line segments 206 in a scan line sequence). In different examples, the frame 200 varies with regards to the number of scan line segments 206 in a sub-period 204, with regards to the number of sub-periods 204 in the interval 202 and with regards to the size of the blank time interval 208. With a non-distributed blank time interval 208 as shown in the frame 200, there is a possibility of undesirable black field phenomena.

Figure 3:
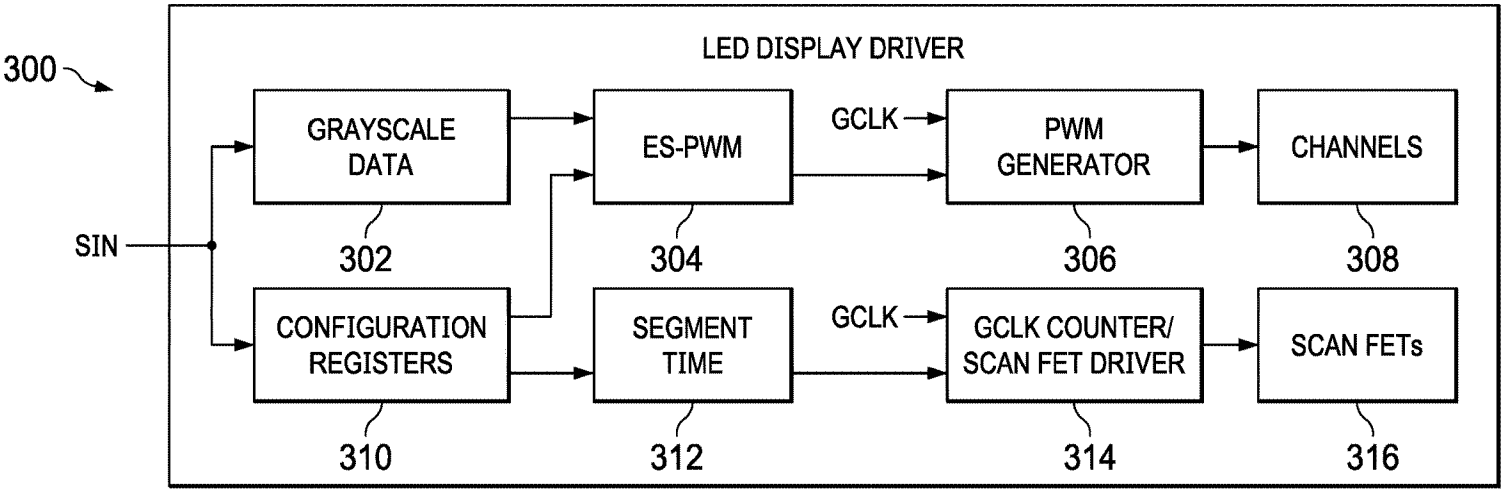
FIG. 3 (PRIOR ART)
FIG. 3 is a block diagram of a light-emitting diode (LED) display driver in accordance with a conventional approach.

FIG. 3 is a block diagram of an LED display driver 300 in accordance with a conventional approach. In FIG. 3, the LED display driver 300 includes various coupled blocks, including a grayscale data block 302, an enhanced spectrum pulse width modulation (ES-PWM) block 304, a PWM generator block 306, and channels 308. The LED display driver 300 also includes other blocks including configuration registers 310, a segment time block 312, a global clock (GCLK), counter/scan FET driver block 314 and scan FETs 316.

More specifically, the grayscale data and the configuration values are transmitted from a data input (e.g., a serial input or SIN) to the LED display driver 300. The grayscale data block 302 represents the received grayscale data or related storage. Also, the configuration values are stored by the configuration registers 310. In operation, the LEDs in an LED matrix are switched on and off based on GCLK. More specifically, the ES-PWM block 304: receives the grayscale data from the grayscale data block 302; receives configuration values from the configuration registers 310; and calculates the channel on/off time. The ES-PWM block 304 then transmits the channel on/off time to the PWM generator 306 to generate PWM signals for each channel. Moreover, the segment time in the configuration registers 310 is used as the threshold of a GCLK counter of the GCLK counter/scan FET driver block 314. Once the counter value equals a scan line segment time, the GCLK counter/scan FET driver block 314 generates FET control signals to turn respective scan FETs 316 on/off.

LED displays, such as those used at stages and stadiums, post videos or advertisements. One design goal is to ensure that the information on LED displays can be filmed by camera. In one example, a camera uses a camera integration time in addition to a conversion time to process photo data. In different scenarios, the blank time may fall into a camera integration phase, the conversion phase, or be partially in the camera integration phase and partially in the conversion phase.

Figure 4:
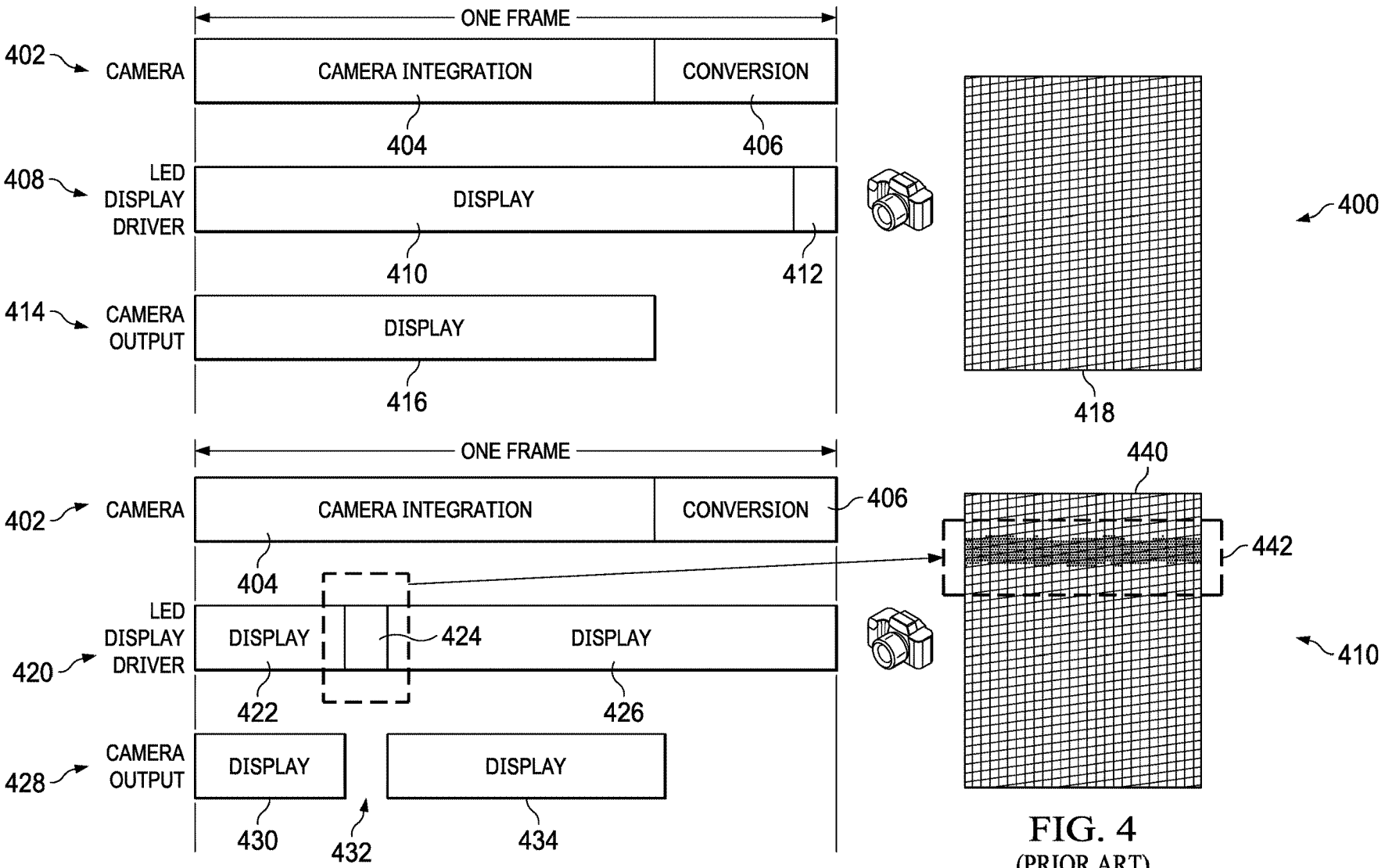
FIG. 4 (PRIOR ART)
FIG. 4 are diagrams of a frame or display interval and related timing issues in accordance with a conventional approach.

FIG. 4 includes diagrams 400 and 410 of a frame or display interval and related timing issues in accordance with a conventional approach. In diagram 400, camera data 402, LED driver data 408, and camera output data 414 are shown for one frame. As shown, the camera data 402 includes a camera integration interval 404 and a conversion interval 406. The LED driver data 408 includes a display interval 410 and a blank time interval 412. The camera output data 414 includes a display interval 416. When the blank time interval 412 falls in the conversion interval 406, the image 418 captured by a camera is normal.

In diagram 410, the camera data 402, LED driver data 420, and camera output data 428 are shown for one frame. Again, the camera data 402 includes the camera integration interval 404 and the conversion interval 406. The LED driver data 420 includes a display interval 422, a blank time interval 424, and a display interval 426. The camera output 428 includes display intervals 430 and 434 separated by an interval 432. When the blank time 424 at least partially falls in the camera integration interval 404, some LED lines will lose their data, which will cause the black field phenomenon 442 (a darker area) shown in image 440.

Figure 5:
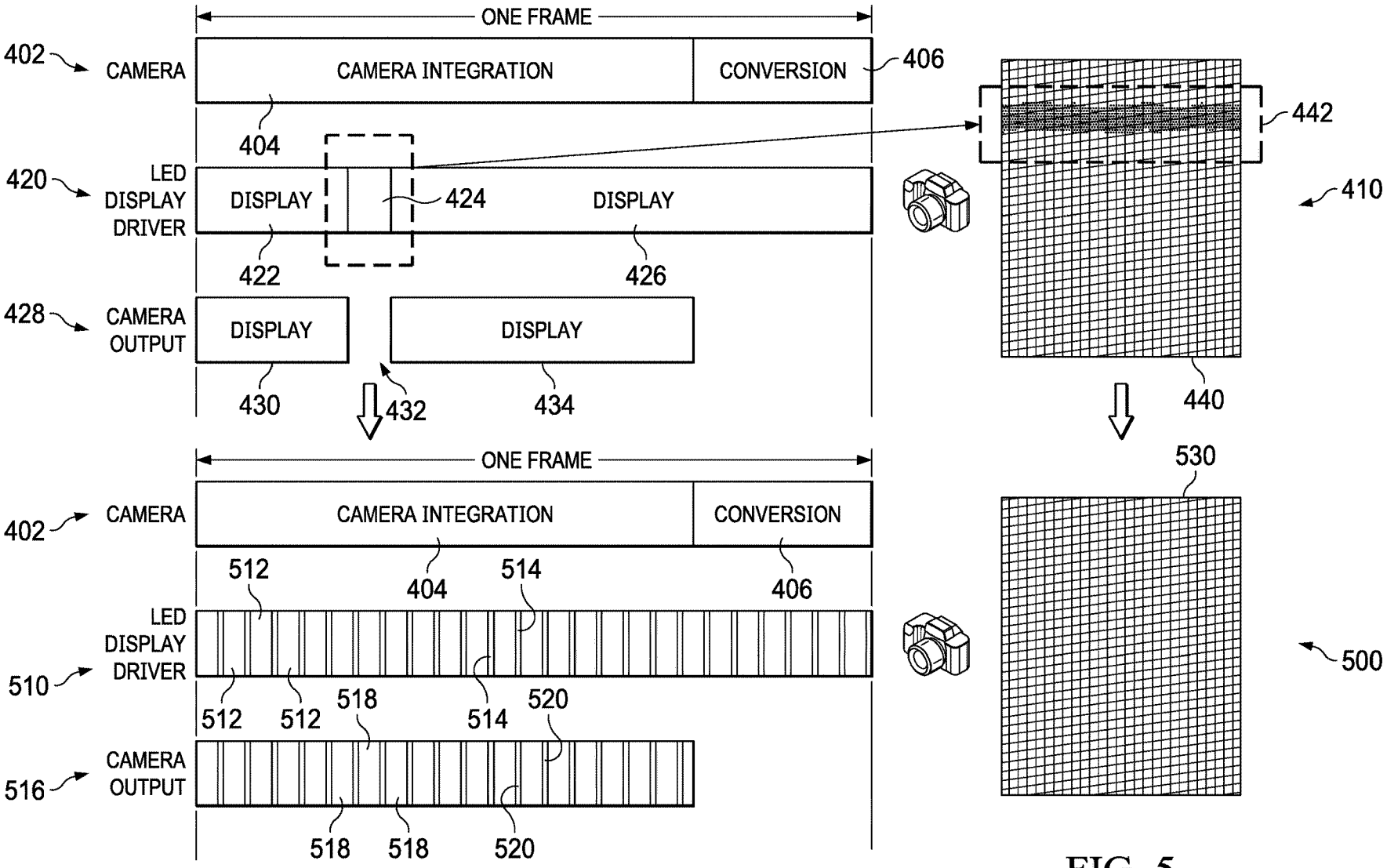
FIG. 5 are diagrams of a frame or display interval and related timing issues in accordance with an example embodiment.

FIG. 5 includes diagrams 410 and 500 of a frame or display interval and related timing issues in accordance an example embodiment. The diagram 410 was described for FIG. 4, where black field phenomenon 442 (a darker area) is in image 440. To avoid instances of such black field phenomenon, blank time distribution is performed as in diagram 500. In diagram 500, the camera data 402, LED driver data 510, and camera output data 516 are shown for one frame. Again, the camera data 402 includes the camera integration interval 404 and the conversion interval 406. The LED driver data 510 includes many display intervals 512 separated by small intervals 514 that distribute the blank time. The camera output 516 includes display intervals 518 separated by small intervals 520. As it is the blank time that causes black field phenomena, the described solution addresses the problem by distributing the blank time to segments or sub-periods, regardless of whether a blank time interval is aligned with the camera integration interval.

In some scenarios, the amount of blank time may be sufficiently small to forego blank time distribution operations. Accordingly, in some example embodiments, a distribution threshold is used. If the amount of blank time is below the distribution threshold, then blank time distribution operations are foregone. Otherwise, if the amount of blank time is equal to or above the distribution threshold, then blank time distribution operations are performed.

The blank time interval, $T_{Blank}$, can be approximated digitally as a number of GCLK cycles, e.g. $T_{Blank}$=N_TB*GCLK period, where N_TB is the number of GCLK cycles of a given period needed to approximate $T_{Blank}$. In one example, suppose the number n of sub-periods in each frame is 64, and there are m=32 lines in the LED matrix. In this example, the number of segments in each frame is m×n=2048. In some example embodiments, the proposed solution distributes the blank time in each frame through three steps represented in FIGS. 6A-6C.

Figure 6A:
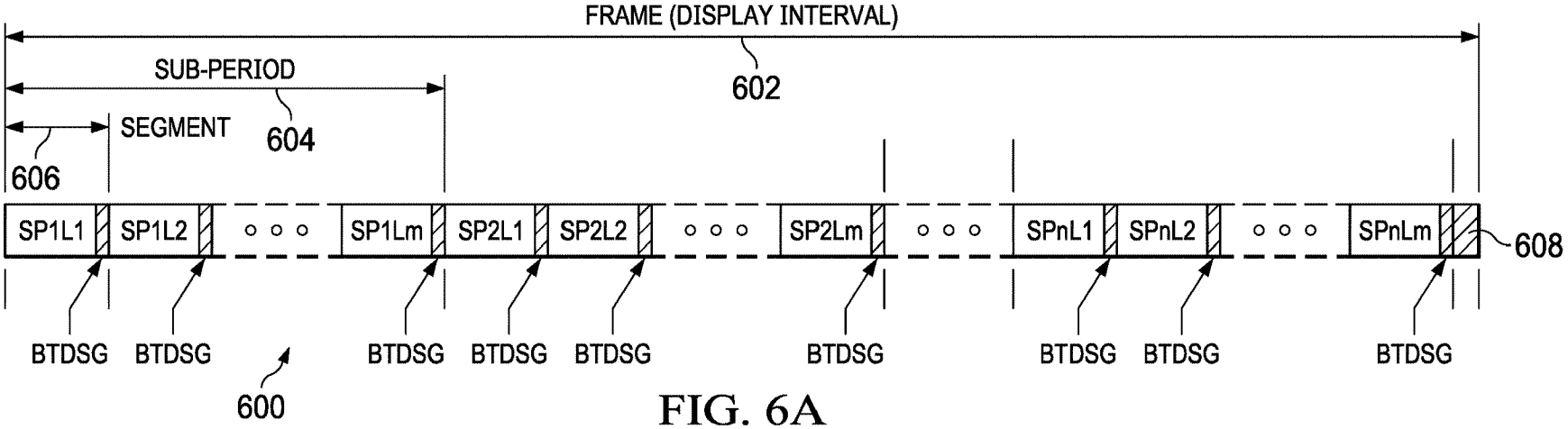
FIG. 6A-6C are diagrams of a frame or display interval and blank time distribution options in accordance with example embodiments.

The first step is to break down the blank time to each segment when N_TB>m×n. For example, if N_TB=6480 GCLK cycles, then the 6480 GCLK cycles is larger than 64×32=2048. Accordingly, N_TB=6480/2048=3 with 336 GCLK cycles remaining. In this example, 3 GCLK cycles are inserted at the end of each original segment. FIG. 6A shows a frame 600 with an interval 602, sub-periods 604, segments 606, blank time distributions (labeled BTDSG) at the end of each of the segments 606, and remaining blank time 608.

Figure 6B:
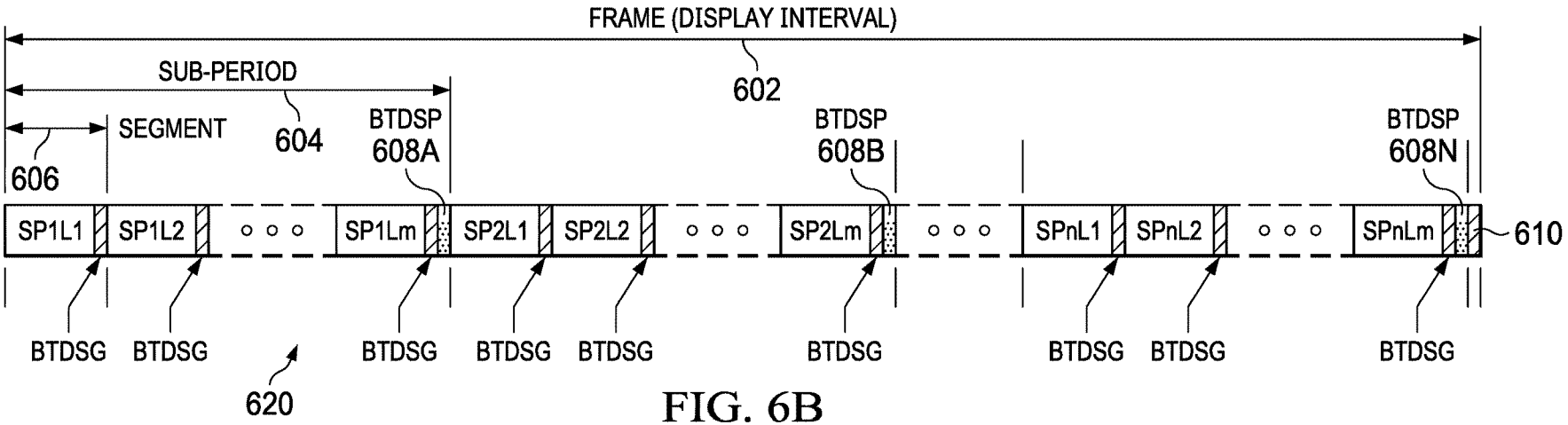

In some example embodiments, the remaining 336 GCLK cycles of blank time may be distributed in a second step, but not to each segment as there are more segments (2048 in this example) than the remaining 336 GCLK cycles of blank time. Accordingly, blank time distribution operations may break down the blank time to each sub-period when m×n>N_TB'>n. For example, the remaining N_TB'=336 GCLKs cycles, which is larger than 64 (the number of sub-periods in this example). Accordingly, breaking down N_TB' results in 336/64=5 GCLK cycles for each sub-period with 16 remaining GCLK cycles of blank time. In this example, 5 GCLK cycles are inserted at the end of each sub-period. FIG. 6B shows a frame 620 with an interval 602, sub-periods 604, segments 606, blank time distributions (labeled BTDSG) at the end of each of the segments 606, blank time distributions 608A-608N (labeled BTDSP) at the end of each of the sub-periods 604, and a remaining blank time 610.

Figure 6C:
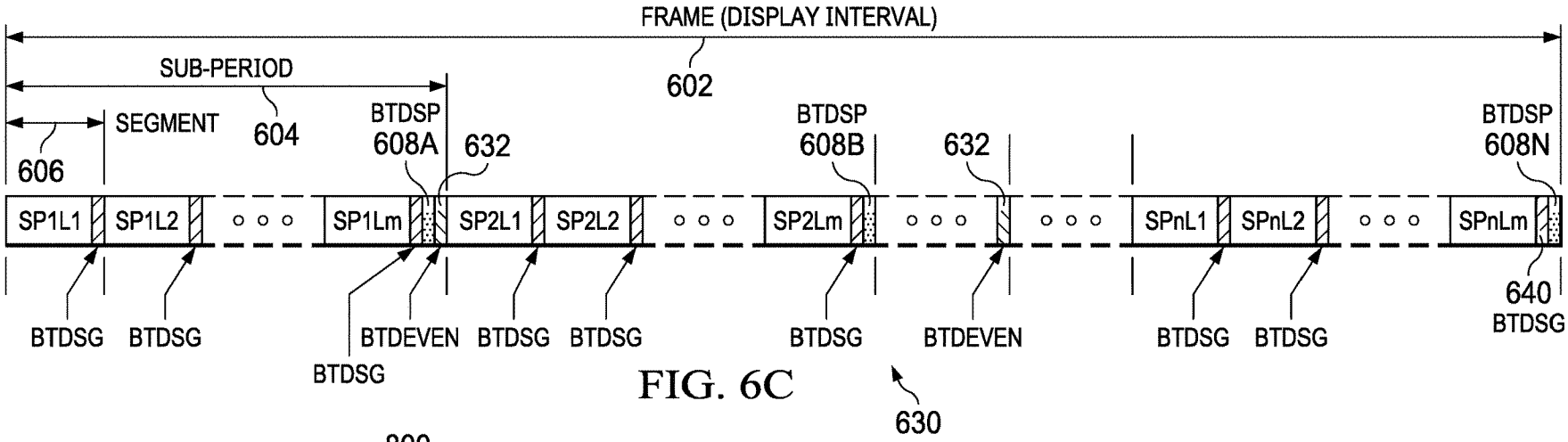

The remaining blank time N_TB" after step two includes 16 GCLK cycles (336−(64×5)), which may be distributed in a third step. In the third step, breakdown of blank time to certain sub-periods when n>N_TB>0 is performed. More specifically, the remaining N_TB"=16 GCLK cycles after step two, which is smaller than 64 (the number of sub-periods), and is not enough to be distributed to each sub-period. In some example embodiments, these 16 GCLK cycles are evenly inserted after every n/16 sub-periods. In one example, one GCLK cycle is inserted at the end of each of the selected sub-periods SP1, SP5, SP9, . . . , SP61. FIG. 6C shows a frame 630 with an interval 602, sub-periods 604, segments 606, blank time distributions (labeled BTDSG) at the end of each of the segments 606, blank time distributions 608A-608N (labeled BTDSP) at the end of each of the sub-periods 604, and blank time distributions 632 (labeled BTDEVEN) evenly distributed at the end of some of the sub-periods 604. In some example embodiments, BTDEVEN distributions 632 are selected based on dichotomy to ensure the GCLK cycles in the remaining N_TB" are evenly distributed in the frame.

Figure 7:
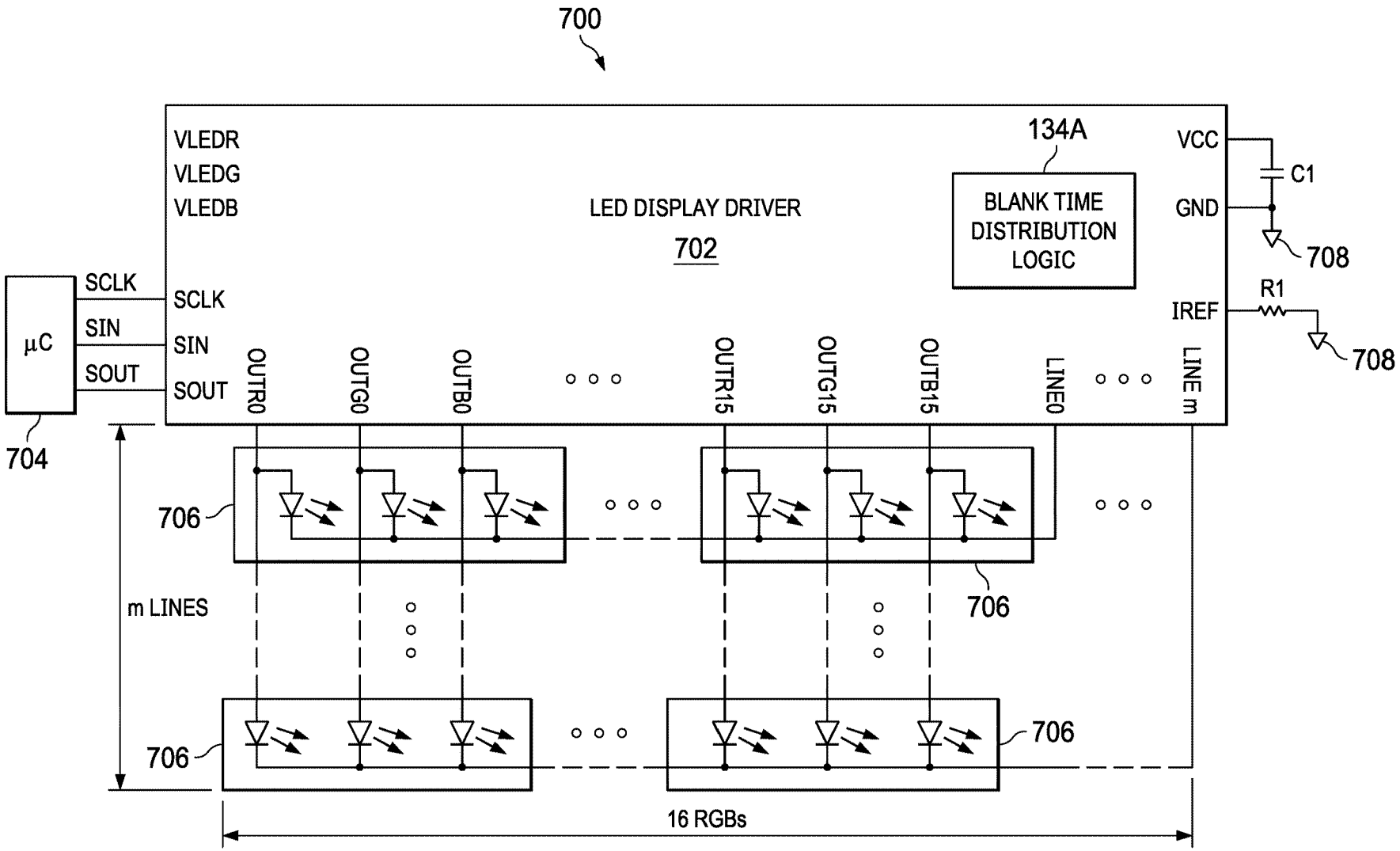
FIG. 7 is a diagram of a LED display driver and related components in accordance with an example embodiment.

FIG. 7 is a diagram 700 of a LED display driver 702 and related components in accordance with an example embodiment. In FIG. 7, the LED display driver 702 is an example of one of the LED submodules 114A-114H in FIG. 1. As shown, the LED display driver 702 is coupled to a microcontroller 704 (e.g., the on-board controller 118 of FIG. 1 or other LED display controller). In the example of FIG. 7, the microcontroller 704 communicates with the LED display driver 702 via a serial communication interface with a serial clock (SCLK) terminal, a data input such as a serial data in (SIN) terminal, and a data output such as a serial data output (SOUT) terminal. The LED display driver 702 also includes red, greed, and blue voltage inputs (VLEDR, VLEDG, VLEDB). The LED display driver 702 also includes 48 LED channel outputs (OUTR0-OUTR15, OUTG0-OUTG15, OUTB0-OUTB15). The LED display driver 702 also includes scan lines (LINE0-LINEm).

In the example of FIG. 7, the LED display driver 702 is coupled to 16 sets of pixels 706, where LED channel outputs (OUTR0-OUTR15, OUTG0-OUTG15, OUTB0-OUTB15) are coupled to the LED anodes, and the scan lines (LINE0-LINEm) are coupled to LED cathodes. As shown, the LED display driver 702 also includes a reference current (IREF) terminal coupled to a ground 708 via a resistor R1. The LED display driver 702 also includes a voltage common collector (VCC) terminal coupled to the ground 708 via a capacitor C1. The LED display driver 702 also includes a ground terminal (GND) coupled to the ground 708. In the example of FIG. 7, the LED display driver 702 also includes blank time distribution logic 134A (an example of the blank time distribution logic 134 in FIG. 1) to perform blank time distribution operations as described herein. In some example embodiments, LED display driver 702 may be implemented on a single semiconductor die and packaged accordingly. In such example embodiments, LED display driver 702 may be packaged with a lead-frame, ball grid array, pin grid array or any other type of semiconductor device technology.

Figure 8:
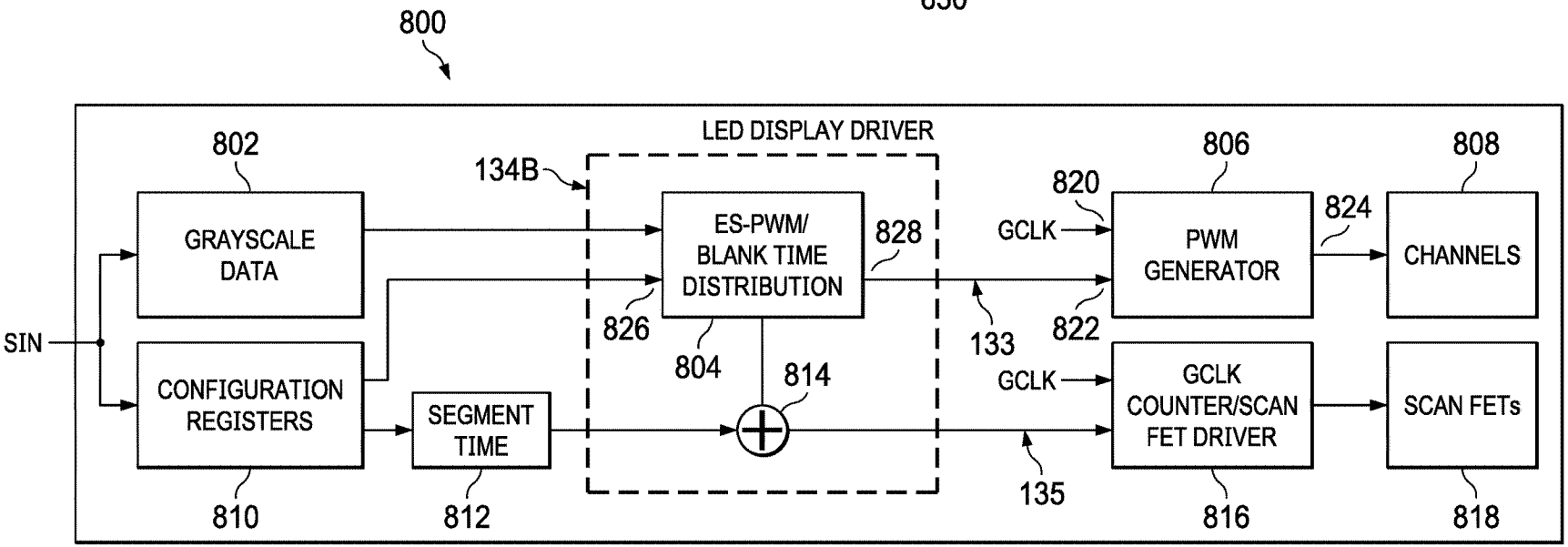
FIG. 8 is a block diagram of a LED display driver in accordance with an example embodiment.

FIG. 8 is a block diagram of a LED display driver 800 (an example of each of the LED submodules 114A-114H in FIG. 1, or the LED display driver 702 in FIG. 7) in accordance with an example embodiment. In FIG. 8, the LED display driver 800 includes various coupled blocks, including a grayscale data block 802, an ES-PWM with blank time distribution block 804, a PWM generator block 806, and LED channels 808. The LED display driver 800 also includes other blocks including configuration registers 810, a segment time block 812, a summation block 814, a global clock (GCLK), counter/scan FET driver block 816, and scan FETs 818. In the example of FIG. 8, the ES-PWM with blank time distribution block 804 and the summation block 814 are components of blank time distribution logic 1346 (an example of the blank time distribution logic 134 in FIG. 1 or the blank time distribution logic 134A in FIG. 7)

In FIG. 8, the grayscale data and the configuration values are transmitted from a data input (e.g., a serial input or SIN) to the LED display driver 800. The grayscale data block 802 represents the received grayscale data or related storage. Also, the configuration values are stored by the configuration registers 810. The configuration registers 810 receive input data from SIN. The data in these configuration registers 810 are used to configure the working status and the scan line sequence of the LED display driver device 800. In some example embodiments, the configuration registers 810 store a blank time distribution setting or related information determined by an LED display controller and provided via SIN to the LED display driver device 800.

When a vertical sync (VSYNC) command to start a new frame comes, the LED display driver 800 moves the grayscale data to ES-PWM with blank time distribution block 804. The ES-PWM with blank time distribution block 804 receives the grayscale data from the grayscale data block 802 and configuration values from the configuration registers 810, and calculates the channel on/off time in a manner that accounts for blank time distribution as described herein. In some example embodiments, the configuration registers 810 are coupled to the logic input of the ES-PWM with blank time distribution block 804, and are configured to store a blank time distribution setting or related information. In one example, the blank time distribution setting is a function of: a blank time clock count and a number of segments in a display interval relative to the blank time clock count.

In some example embodiments, the ES-PWM with blank time distribution block 804 calculates the blank time in each frame, and breaks down and distributes the blank time into corresponding segments and sub-periods following the steps described in FIGS. 6A-6C. Based on the blank time distribution operations, the ES-PWM with blank time distribution block 804 transmits the control signals 133 (e.g., channel on/off time) to the PWM generator block 806 to generate PWM signals for each of the LED channels 808.

The LED display driver 800 also extends the line switch time of each scan line by: adding distributed blank time after the original segment time and then transmitting the modified segment time to the GCLK counter/scan FET driver block 816 as the new threshold to turn on/off the scan FETs 818 to control the corresponding scan lines of the LED matrix. In some example embodiments, the segment time in the configuration registers 810 is used as the threshold of the GCLK counter of the GCLK counter/scan FET driver block 816. More specifically, the segment time block 812 extracts the segment time information from the data in the configuration registers 810. The segment time information extracted by the segment time block 812 is used as a reference value together with the blank time distribution information to drive scan FETs 818 of the lines of the LED matrix based on GCLKs. In one example, the ES-PWM with blank time distribution block 804 provides blank time distribution information to the summation block 814 to add blank time distribution clock cycles to the segment times from the configuration registers 810 or the segment times extracted by the segment time block 812 as appropriate. Once the counter value equals a modified scan line segment time, the GCLK counter/scan FET driver block 816 generates FET control signals to turn respective scan FETs 818 on/off.

In some example embodiments, the LED display driver 800 includes a set of LED channels 808 and PWM circuitry (e.g., the PWM generator block 806 in FIG. 8) having a PWM control input 822, a clock input 820, and a PWM circuitry output 824. The PWM circuitry output 824 is coupled to the set of LED channels 808. The LED display driver 800 also includes blank time distribution logic (e.g., the ES-PWM with blank time distribution block 804 and the summation block 814) having a logic input 826 and a logic output 828. The logic output 828 is coupled to the PWM control input 822. The blank time distribution logic is configured to provide control signals 133 to the logic output 828 responsive to a blank time distribution setting as described herein.

Figure 9:
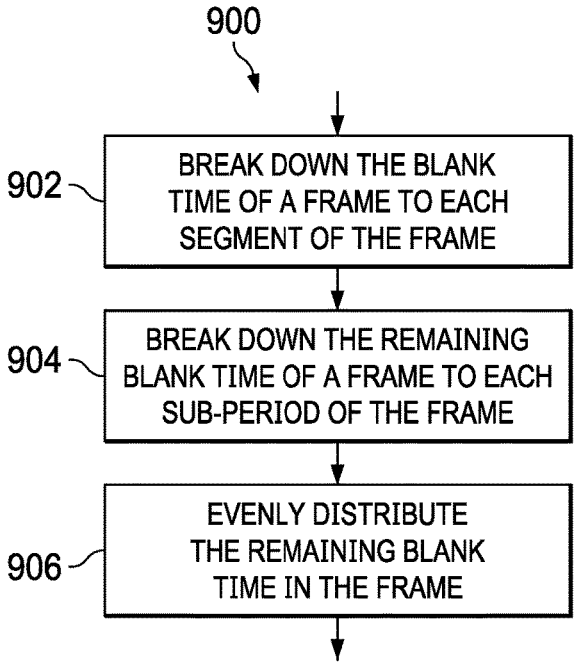
FIG. 9 is a flowchart of a blank time distribution method in accordance with an example embodiment.

FIG. 9 is a flowchart of a blank time distribution method 900 in accordance with an example embodiment. The method 900 is performed, for example, by an LED display driver (e.g., each of the LED submodules 114A-114H in FIG. 1, the LED display driver 702 in FIG. 7, or the LED display driver 800 in FIG. 8). As shown, the method 900 includes breaking down the blank time of a frame to each segment of a frame at block 902. At block 904, the remaining blank time of a frame is broken down to each sub-period of the frame. At block 906, the remaining blank time of the frame is evenly distributed to some of the sub-periods of the frame.

Figure 10:
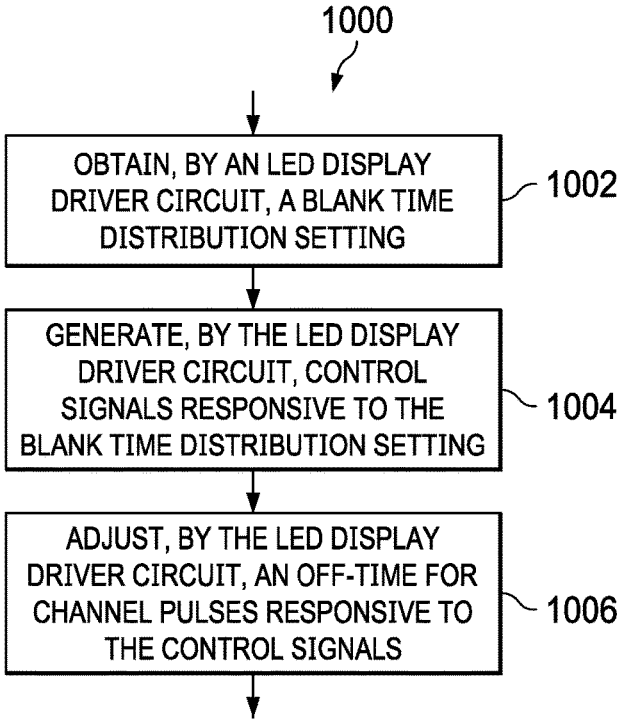
FIG. 10 is a flowchart of a blank time distribution method in accordance with an example embodiment.

FIG. 10 is a flowchart of a blank time distribution method 1000 in accordance with an example embodiment. The method 1000 is performed, for example, by an LED display driver (e.g., each of the LED submodules 114A-114H in FIG. 1, the LED display driver 702 in FIG. 7, or the LED display driver 800 in FIG. 8) for distributing blank time portions to a display interval with sub-periods, each sub-period having multiple segments, and a blank time. As shown, the method 1000 includes obtaining, by an LED display driver, a blank time distribution setting at block 1002. In some example embodiments, the blank time distribution setting or related blank time information is provided by an LED display controller (e.g., the on-board controller 118 in FIG. 1, or the microcontroller 704 in FIG. 7). At block 1004, control signals (e.g., control signals 133 in FIGS. 1 and 8) are generated by the LED display driver, responsive to the blank time distribution setting. At block 1006, an off-time for channel pulses are adjusted, by the LED display driver, responsive to the control signals.

In some example embodiments, the method 1000 includes determining the blank time distribution setting as a function of a number of segments in a display interval relative to a blank time clock count. In some example embodiments, adjusting the off-time at block 806 results in: distributing a blank time portion to each segment of each sub-period of a display interval responsive to the blank time being greater than a first threshold; distributing a blank time portion to each sub-period, but not each segment of each sub-period, of the display interval responsive to the blank time being equal to or less than the first threshold and greater than a second threshold; and distributing a blank time portion to only some sub-periods of a display interval responsive to the blank time being equal to or less than the second threshold. In some example embodiments, the method 1000 includes providing, by the LED display driver, a sequence of drive signals to respective switches of a set of scan lines, the sequence of drive signals accounting for changes in a segment time interval responsive to the blank time distribution setting.

In this description, the term "couple" may cover connections, communications, or signal paths that enable a functional relationship consistent with this description. For example, if device A generates a signal to control device B to perform an action: (a) in a first example, device A is coupled to device B by direct connection; or (b) in a second example, device A is coupled to device B through intervening component C if intervening component C does not alter the functional relationship between device A and device B, such that device B is controlled by device A via the control signal generated by device A.

As used above, the terms "terminal", "node", "interconnection" and "pin" are used interchangeably. Unless specifically stated to the contrary, these terms are generally used to mean an interconnection between or a terminus of a device element, a circuit element, an integrated circuit, a device or other electronics or semiconductor component.

Modifications are possible in the described embodiments, and other embodiments are possible, within the scope of the claims.

What is claimed is:

1. A light-emitting diode (LED) display driver having a display interval with sub-periods and a blank time, each sub-period having multiple segments, and the LED display driver comprising:

a data input;

LED channel outputs configured to provide LED drive signals; and blank time distribution logic coupled between the data input and the LED channel outputs, the blank time distribution logic operable to distribute the blank time as blank time portions added to at least some of the sub-periods responsive to a comparison of the blank time with each of multiple thresholds, wherein each blank time portion is smaller than a duration of each sub-period, and wherein the blank time distribution logic is configured to:

distribute at least one of the blank time portions to each segment of each sub-period of the display interval responsive to the blank time being greater than a first threshold of the multiple thresholds;

distribute at least one of the blank time portions to each sub-period, but not each segment of each sub-period, of the display interval responsive to the blank time being equal to or less than the first threshold and greater than a second threshold of the multiple thresholds; and distribute at least one of the blank time portions to only some sub-periods of the display interval responsive to the blank time being equal to or less than the second threshold.

2. The LED display driver of claim 1, further comprising PWM circuitry coupled to each of the LED channel outputs and configured to adjust an off-time of PWM signals provided by the PWM circuitry to the LED channel outputs responsive to control signals from the blank time distribution logic.

3. The LED display driver of claim 1, wherein the blank time distribution logic is configured to distribute at least one of the blank time portions to each segment of each sub-period of the display interval.

4. The LED display driver of claim 1, wherein the blank time distribution logic is configured to distribute at least one of the blank time portions to each sub-period of the display interval, but not each segment of each sub-period.

5. The LED display driver of claim 1, wherein the blank time distribution logic is configured to distribute at least one of the blank time portions to some sub-periods, but not all sub-periods, of the display interval.

6. The LED display driver of claim 1, further comprising a configuration register coupled to the data input and configured to store a blank time distribution setting, wherein the blank time distribution setting is a function of:

a blank time clock count; and a number of segments in the display interval relative to the blank time clock count.

7. The LED display driver of claim 6, wherein the configuration register is configured to receive the blank time distribution setting from an LED display controller external to the LED display driver circuit.

8. The LED display driver of claim 6, further comprising:

a set of scan lines, each scan line having a respective switch; and a scan line controller coupled to each respective switch of the set of scan lines, the scan line controller configured to provide a sequence of drive signals to respective switches of the set of scan lines, and the sequence of drive signals accounting for changes in a time interval for each segment of each sub-period responsive to the blank time distribution setting.

9. A system, comprising:

a light-emitting diode (LED) display controller; and an LED display driver coupled to the LED display controller and configured to receive LED data from the LED display controller, the LED display driver configured to drive LEDs of an LED display, and having a display interval with sub-periods and a blank time, wherein each sub-period has multiple segments, and the LED display driver includes:

a data input;

LED channel outputs adapted to be coupled to LEDs of the LED display; and blank time distribution logic coupled to the data input and the LED channel outputs, the blank time distribution logic operable to distribute the blank time as blank time portions added to at least some of the sub-periods of the display interval based on a comparison of the blank time with each of multiple thresholds, wherein each blank time portion is smaller than a duration of each sub-period, and wherein the blank time distribution logic is configured to:

distribute at least one blank time portion to each segment of each sub-period of the display interval responsive to the blank time being greater than a first threshold of the multiple thresholds;

distribute at least one blank time portion to each sub-period, but not each segment of each sub-period, of the display interval responsive to the blank time being equal to or less than the first threshold and greater than a second threshold of the multiple thresholds; and distribute a blank time portion to only some sub-periods, but not all sub periods, of the display interval responsive to the blank time being equal to or less than the second threshold.

10. The system of claim 9, wherein the blank time distribution logic is configured to distribute at least one of the blank time portions to each segment of each sub-period of the display interval.

11. The system of claim 9, wherein the blank time distribution logic is configured to distribute at least one of the blank time portions to each sub-period of the display interval, but not each segment of each sub-period of the display interval.

12. The system of claim 9, wherein the blank time distribution logic is configured to distribute a blank time portion to some but not all sub-periods of the display interval.

13. The system of claim 9, wherein the LED display driver includes a configuration register coupled to the data input and configured to store a blank time distribution setting, wherein the blank time distribution setting is a function of:

a blank time clock count; and a total number of segments in the display interval relative to the blank time clock count.

14. The system of claim 13, wherein the configuration register is configured to receive the blank time distribution setting from the LED display controller.

15. The system of claim 13, wherein the LED display driver includes:

a set of scan lines, each scan line having a respective switch; and a scan line controller coupled to each respective switch of the set of scan lines, the scan line controller configured to provide a sequence of drive signals to respective switches of the set of scan lines, and the sequence of drive signals accounting for changes in a time interval for each segment of each sub-period responsive to the blank time distribution setting.

16. A method for distributing blank time portions of a display interval with a blank time and sub-periods, each sub-period having multiple segments, the method comprising:

obtaining, by a light-emitting diode (LED) display driver, a blank time distribution setting;

generating control signals, by the LED display driver, responsive to the blank time distribution setting; and adjusting, by the LED display driver, an off-time for LED channel pulses responsive to the control signals, including:

distributing the blank time portions to at least some of the sub-periods based on a comparison of the blank time with each of multiple thresholds;

distributing at least one of the blank time portions to each segment of each sub-period of the display interval responsive to the blank time being greater than a first threshold of the multiple thresholds;

distributing at least one of the blank time portions to each sub-period, but not each segment of each sub-period, of the display interval responsive to the blank time being equal to or less than the first threshold and greater than a second threshold of the multiple thresholds; and distributing at least one of the blank time portions to only some sub-periods of the display interval responsive to the blank time being equal to or less than the second threshold.

17. The method of claim 16, further comprising determining the blank time distribution setting as a function of a total number of segments in the display interval relative to a blank time clock count.

18. The method of claim 16, further comprising providing, by the LED display driver, a sequence of drive signals to respective switches of a set of scan lines, the sequence of drive signals accounting for changes in a time interval for each segment of each sub-period responsive to the blank time distribution setting.

* * * * *